United States Patent [19]

Herron

[11] Patent Number: 4,784,391

[45] Date of Patent: Nov. 15, 1988

[54] ROPE GAME DEVICE

[76] Inventor: Sylvia T. Herron, 6221 S. Cottage Grove, Chicago, Ill. 60637

[21] Appl. No.: 927,819

[22] Filed: Nov. 6, 1986

[51] Int. Cl.[4] ..... A63B 67/10; A63B 63/00; A63B 67/00

[52] U.S. Cl. ..... 273/109; 273/332; 273/126 R; 273/1 G; 273/414; 446/490

[58] Field of Search ..... 273/1 G, 108, 109, 126, 273/332, 402, 413, 414; 272/116, 902, 75; 446/119, 245, 489, 490

[56] References Cited

U.S. PATENT DOCUMENTS

| | | | |
|---|---|---|---|
| 3,078,614 | 2/1963 | Fors et al. | 446/489 |
| 3,554,542 | 1/1971 | Span | 273/1 G |
| 3,643,947 | 2/1972 | Collins | 273/414 |
| 3,731,929 | 5/1973 | Landry | 273/414 |
| 4,177,985 | 12/1979 | Hlasnicek et al. | 272/75 |

FOREIGN PATENT DOCUMENTS

| | | | |
|---|---|---|---|
| 2365917 | 10/1976 | France | 272/116 |

*Primary Examiner*—Richard C. Pinkham
*Assistant Examiner*—Gary Jackson
*Attorney, Agent, or Firm*—Kenneth J. Pedersen

[57] ABSTRACT

A new rope game device is disclosed. Threaded on a rope about six feet long with handles on its ends are two larger cylinders, one for each player. Also threaded on the rope is a plurality of smaller cylinders which can pass through the interior of the larger cylinders. In the game two players shake the rope, moving the smaller cylinders toward them through the larger cylinders to claim, and score, them close to the handles.

6 Claims, 1 Drawing Sheet

ROPE GAME DEVICE

BACKGROUND OF THE INVENTION

This invention relates to games and toys. In my invention two players shake, pull and push on the handles of a rope or cord between them.

On the rope are two larger cylinders, one for each player. Also on the rope is a plurality of smaller cylinders. The object of the game is to shake the smaller cylinders through the interior of a player's larger cylinder, in the direction of a player's own handle, and "capture" them between the larger cylinder and the player's handle. The player with the most "captured" smaller cylinders wins the game.

This invention is properly classified in U.S. Patent Class 446, Subclass 245—Toys with Ropes or Cords, including yo-yo's, tops and other spinning toys.

SUMMARY OF THE INVENTION

My invention is:

(a) a rope, with;
(b) two handles, one on each end of the rope;
(c) two larger, substantially hollow cylinders threaded on said rope, disposed between said handles; and
(d) a plurality of smaller cylinders with a central passageway along their longitudinal axes, also threaded on said rope and disposed between said handles;

wherein the smaller cylinders are able to pass through the interior of the larger cylinders.

Preferably:

(e) the rope is between four and ten feet long;
(f) the handles are metal rings between two and five inches in diameter;
(g) the larger cylinders are truncated cones with their smaller ends disposed toward the handles and their larger ends disposed away from the handles;
(h) the smaller ends of the truncated cones are between two and four inches in diameter, and the larger ends are between four and six inches in diameter;
(i) there are between 18 and 30 smaller cylinders.
(j) the smaller cylinders are about 1.5 inches in diameter.

DESCRIPTION OF THE PREFERRED EMBODIMENTS

Figure 1:
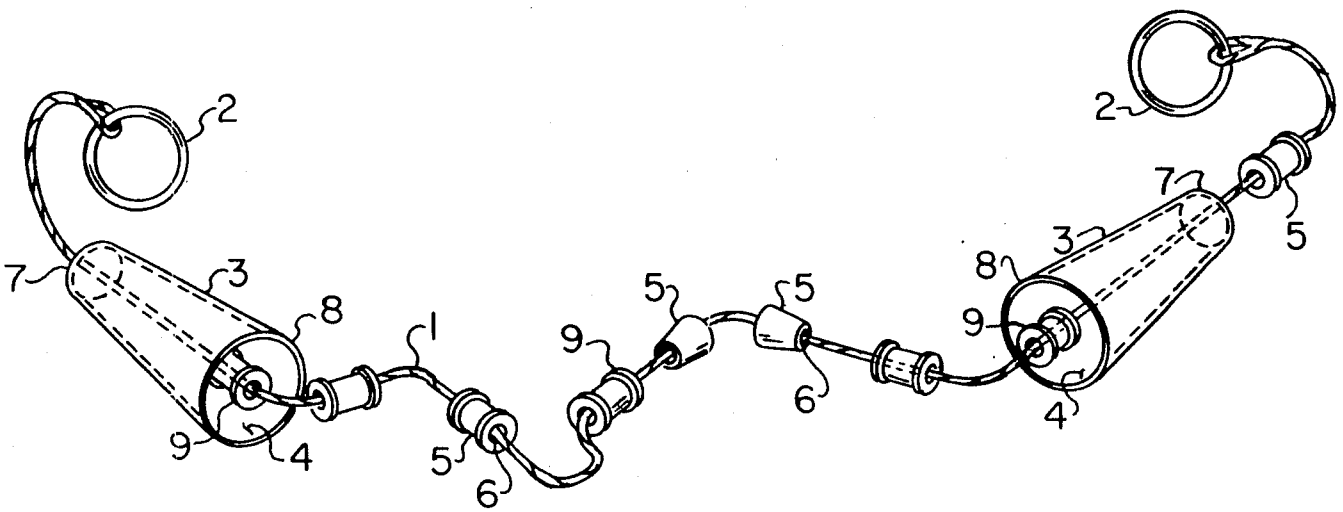
FIG. 1 is a perspective view, partly in crosssection, of an embodiment of my invention, showing a rope with two handles, two larger cylinders on the rope, and a plurality of smaller cylinders also on the rope.

Referring now to the accompanying Drawing:

FIG. 1 depicts: rope (1), with two handles (2) on each end of the rope; two substantially hollow larger cylinders (3) threaded on the rope (1) through the interior (4) of said larger cylinders, and disposed between said handles (2).

In this depicted embodiment of my invention the larger cylinders (3) are actually truncated cones with their smaller ends (7) disposed toward the handles (2), and with their larger ends (8) disposed away from the handles (2).

FIG. 1 also depicts: a plurality of smaller cylinders (5) threaded on the rope (1) through the central passageway (6) of said smaller cylinders, and disposed between the handles (2). The smaller cylinders (5) have an outside diameter (9( which is small enough to enable them to pass freely through the interior (4) of the larger cylinders, including through the smaller end (7) thereof.

Regarding the rope (1), it can be flat or round, thick or thin, and made of any common cord material. A round cord about 1/16 to $\frac{1}{4}$ inch in diameter is preferred. Preferably the rope is between four and ten feet long.

The handles (2) can be any construction which serves to improve a player's grip on the end of the rope, even a knot or a wrap will do. Preferably the handles are big enough to prevent the larger and smaller cylinders from coming off the end of the rope. Metal rings between two and five inches in diameter, tied to the end of the rope, are preferred.

The two larger cylinders (3) are substantially hollow—they have a relatively large interior space (4) formed within relatively thin walls. Straight or curved cylinders will do. In fact, truncated cones, with their smaller ends (7) disposed toward the handles (2) and their larger ends (8) disposed away from the handles (2) are preferred for the larger cylinders (3). Generally, the smaller ends of the truncated cones are between two and four inches in diameter, and the larger ends are between four and six inches in diameter. Generally, the larger cylinders, including the truncated cones, are about four to seven inches in length.

The smaller cylinders (5) can be substantially solid, but they must have a central passageway (6) along their longitudinal axes for accepting the rope (1). The passageway (6) must be large enough to enable the smaller cylinders (5) to pass easily back and forth along the length of the rope (1). Generally there are between 18 and 30 smaller cylinders (5) threaded along the rope (1). A preferred number of smaller cylinders is 24. The smaller cylinders (5) have an outside diameter (9) which is small enough to enable them to pass freely through the interior (4) of the larger cylinders (3), including through the smaller end (7) thereof when the larger cylinders are truncated cones. Generally the smaller cylinders are about 1.5 inches in diameter and about two to four inches in length.

Both the larger cylinders (3) and the smaller cylinders (5) can be made of any common construction material. Wood and plastic are preferred materials. The larger cylinders and the smaller cylinders can be made of the same or different materials in the same rope game device, as long as the materials allow one type of cylinder to pass freely by the other.

My rope game device can be easily manufactured from its commonplace components described above. For my best prototype, depicted in FIG. 1 and discussed above, I took about $6\frac{1}{2}$ feet of $\frac{1}{8}$ inch round braided sisal cord and tied a three inch metal ring on one end. Then I threaded two larger cylinders—plastic truncated cones $5\frac{1}{2}$ inches long, $2\frac{1}{2}$ inches in diameter at the smaller ends and 5 inches in diameter at the larger ends—on the rope. Then I threaded 24 smaller cylinders—wooden straight cylinders $2\frac{1}{2}$ inches long and $1\frac{1}{2}$ inches in diameter with a central passageway $\frac{1}{4}$ inch in diameter—on the rope. Then I tied another three inch metal ring on the remaining end of the rope to complete my device.

My rope game device is fun to use. To begin, two players stand facing each other, holding their handle in front of them with one or two hands. In the beginning each player's larger cylinder is next to the player's handle, with no smaller cylinders between the larger cylinder and the handle. On a signal the two players shake and pull on the handles on the rope, moving their larger cylinder out away from them on the rope past some of the smaller cylinders, and moving some of the smaller cylinders in towards them on the rope past their larger cylinder. When a smaller cylinder has been moved towards a player through the interior of a larger cylinder to become located between the larger cylinder and the player's handle, it may be "captured" there by the player grasping it with a hand and holding it there next to the handle. The game is over when one player has "captured" a majority of the smaller cylinders, or a specified number of them, to win.

This description of my invention is meant to illuminate and explain it, but not to limit it, and the functional equivalents of it, within the scope of my patent claims, are meant to be covered by it, the same as if they were also described herein.

What I claim is:

1. A game device comprising:

a. a single cord of rope with two ends, with;

b. two handles, one on each end of the rope;

c. two larger, substantially hollow truncated cones threaded on said rope disposed in opposite direction between said handles, each cone with its smaller end disposed toward the corresponding handle and its larger end disposed toward the middle of the rope, and d. a plurality of smaller cylinders with a central passageway along their longitudinal axis, also threaded on said rope and disposed between said handles;

wherein the smaller cylinders are able to pass through the interior of the larger cylinders.

2. The device of claim 1 wherein the rope is between four and ten feet long.

3. The device of claim 1 wherein the handles are metal rings between two and five inches in diameter.

4. The device of claim 1 wherein the smaller ends of the truncated cones are between two and four inches in diameter, and the larger ends are between four and six inches in diameter.

5. The device of claim 1 wherein there are between 18 and 30 smaller cylinders.

6. The device of claim 1 wherein the smaller cylinders are about 1.5 inches in diameter.

* * * * *